United States Patent [19]

Farris et al.

[11] Patent Number: 4,667,911

[45] Date of Patent: May 26, 1987

[54] DEVICE FOR SUPPORTING A TRASH RECEPTACLE

[76] Inventors: Richard D. Farris; Joy F. Farris, both of 419 Shiloh Rd., Tyler, Tex. 75703

[21] Appl. No.: 757,947

[22] Filed: Jul. 23, 1985

[51] Int. Cl.[4] ..... A63B 55/04

[52] U.S. Cl. ..... 248/97; 248/101; 248/188.1

[58] Field of Search ..... 248/97, 95, 99, 100, 248/101, 96, 151, 188, 188.1, 188.8; D34/6

[56] References Cited

U.S. PATENT DOCUMENTS

| | | | |
|---|---|---|---|
| D. 188,261 | 6/1960 | Kallstrom | D34/6 |
| 2,140,995 | 12/1938 | Groom et al. | 248/97 |
| 2,730,419 | 1/1956 | Watrous et al. | 248/188 |
| 3,494,541 | 2/1970 | Smedlund | 248/97 X |
| 3,614,041 | 10/1971 | Koger | 248/97 |
| 3,838,839 | 10/1974 | Spencer | 248/99 |
| 3,841,592 | 10/1974 | Witten | 248/97 X |
| 4,488,697 | 12/1984 | Garvey | 248/97 X |

*Primary Examiner*—Ramon O. Ramirez
*Attorney, Agent, or Firm*—Harold H. Dutton, Jr.

[57] ABSTRACT

A support for a flexible trash receptacle comprising an upper ring, a plurality of support legs secured in spaced relation at their lower ends and secured at their upper ends to said upper ring for supporting said upper ring, a removable lid assembly comprising a lid member and first and second hinge members, a flexible trash receptacle having an open top positioned within the support and having its open top extending upwardly thorugh the upper ring and turned downwardly around the outside of the upper ring, the lid assembly and the flexible trash receptacle being secured to the upper ring by a resilient band encircling the upper ring and connected to the first hinge member, and the lid member being secured to the second hinge member in position such as to cover the upper ring and the open top of the flexible trash receptacle when in the closed position.

6 Claims, 5 Drawing Figures

FIG. 1
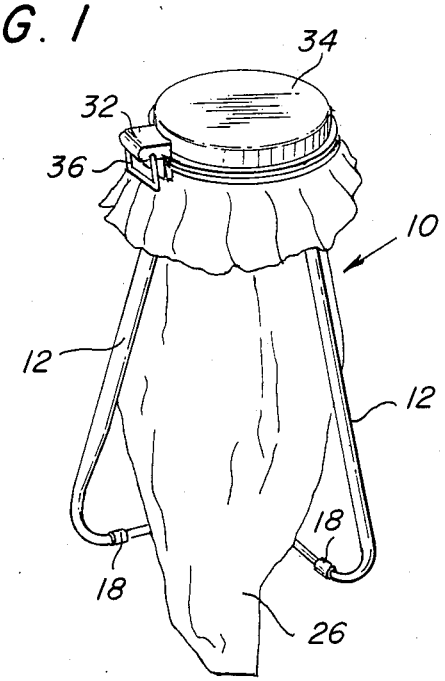
FIG. 2
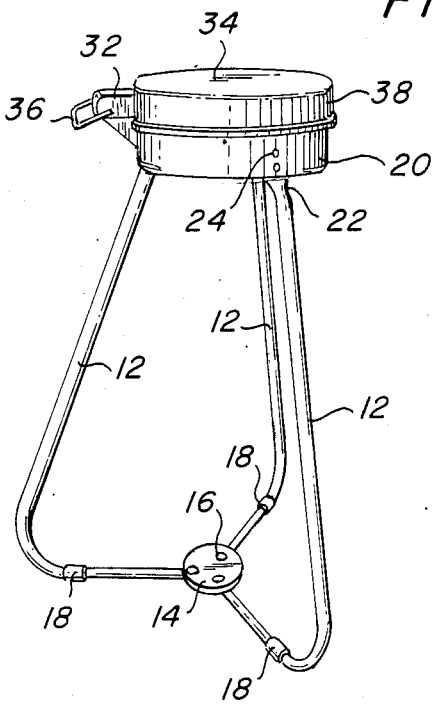
FIG. 3
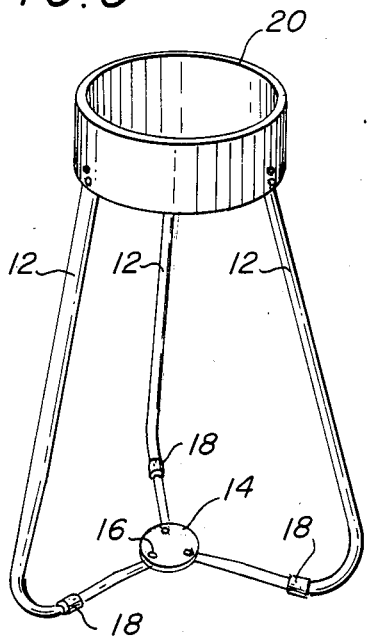
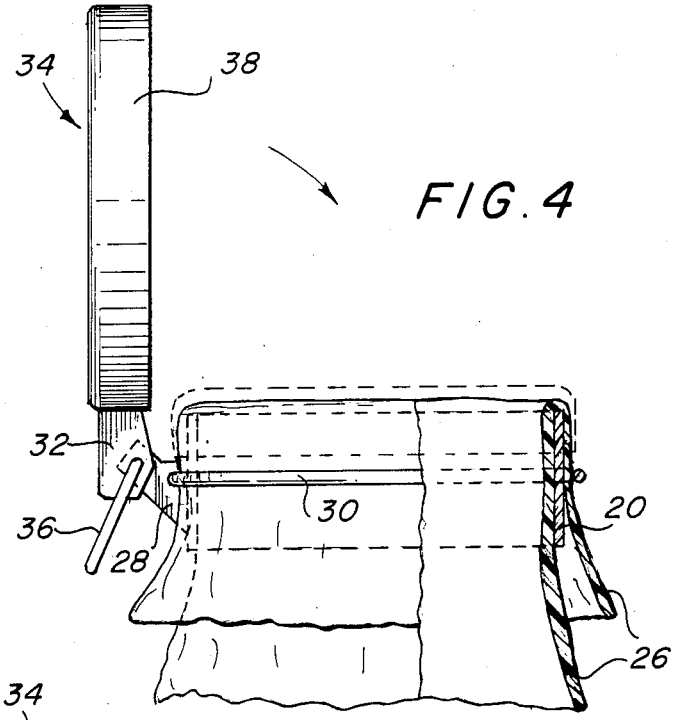
FIG. 4
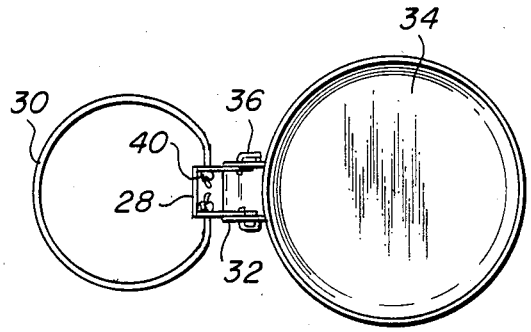
FIG. 5

DEVICE FOR SUPPORTING A TRASH RECEPTACLE

This invention relates to a device for supporting a trash receptacle. More particularly, the invention relates to a device for supporting a trash receptacle, such as a plastic bag, in a upright position whereby the receptacle is in position for easy access for the deposit of trash into the receptacle.

BACKGROUND AND OBJECTS

In recent years, it has become commonplace to use plastic receptacles as trash of rubbish containers. These plastic receptacles are often in the nature of bags which are inexpensive, and when full may be disposed of with little expense. Most commonly, such plastic trash bags are used independently of any other device, and are simply filled with the trash, garbage or the like and then tied shut and discarded.

In other use, these bags may be inserted into a rigid or semi-rigid trash container, much like a liner, and the top of the bag is turned down over the top of the container to hold the bag open and in place in the container. Trash or the like is then simply placed into the bag inside the container, and when the bag is full, it is removed from the container, tied and discarded.

Such trash receptacle/liner use, while of course serving the function intended, presents the significant disadvantage that the top of the trash bag is left open and can therefor be accessible to animals, children and the like, and is also most unsightly and unsanitary in a home, for example in the kitchen. Odors are permitted to escape from the open top of the bag causing unpleasantries in use.

While many such rigid or semi-rigid containers are initially provided with a lid, most often, the lid is not useable when a bag is inserted, or alternatively the bag must be punctured or torn in some way to enable use of the lid. Otherwise, the bag will interfere with the hinge or attaching mechanism of the lid.

The use of plastic bags with such rigid or semi-rigid containers also is often affected by the fact that the container is only open at the top. Thus, when a bag is inserted into the container, the air in the container will prevent full opening of the bag to fill the interior of the container.

Therefor, a primary object of the present invention is to provide an improved device for supporting a flexible trash bag for use.

Another object of the invention is to provide an improved device for supporting a trash bag which overcomes the disadvantages of the prior art.

Still a further object of the present invention is to provide a device for supporting a trash bag or the like which includes a lid.

A further object of the invention is to provide a device for supporting a trash bag and including a lid, the operation of which is not interfered with by the bag.

Yet another object of the invention is to provide a device for supporting a trash receptacle which is lightweight and economical to manufacture and use.

Still another object of the invention is to provide a device for supporting a trash bag or the like, whereby the bag may be readily inserted and expanded as it is filled without difficulty.

These and other objects and advantages of this invention will become apparent when considered together with the accompanying description and claims when taken together with the accompanying drawings.

DESCRIPTION OF THE DRAWINGS

In the accompanying drawings,

FIG. 1 is a perspective view of a device according to the present invention showing the device with a bag in place;

FIG. 2 is a side view of the device with the bag removed;

FIG. 3 is a side view of the device with the top assembly removed;

FIG. 4 is an enlarged side view, with portions broken away for clarity, showing the top assembly;

FIG. 5 is top plan view of the lid assembly with the lid in the open position.

DESCRIPTION OF THE INVENTION

The present invention an open base or stand having a plurality of legs, preferably three in number, connected to a base plate at their lower termini and connected to an upper ring at the top. The base plate serves to retain the lower ends of the legs in position to support the bag and its contents.

The legs are attached to the upper ring at equally spaced points around the ring. The ring has a substantial height and serves as the attaching point for a plastic bag and the lid assembly. The diameter of the upper ring is of a convenient size to permit insertion of trash into the bag and is slightly smaller than the size of the opening in the top of the bag which will be used.

The top assembly includes first and second hinge elements. The first hinge element has a resilient band attached thereto, with the band being of such a diameter that when stretched, it will encircle the upper ring. The second hinge element is connected to the first hinge element along a hinge axis. This second hinge element is secured to a circular lid which is of slightly greater diameter that the upper ring so as to completely cover the upper ring, and includes a downwardly turned lip which extends downwardly along the outside of the upper ring.

In use, a plastic bag is inserted downwardly through the upper ring toward the base plate, and the bag is opened at the top. The top of the bag is then turned down on the outside of the upper ring. The resilient band is then placed around the upper ring and the plastic bag, and this elastic band then secures the bag in place and simultaneously secures the lid assembly in place in such a manner as to cover the open top of the bag.

Since the elastic band is secured to the first hinge element and the lid is secured to the second hinge element, the lid operates freely of interference with the elastic band or the bag, and yet is securely held in place so as to cover the top of the bag.

The legs of the device, being of an open construction, do not interfere with insertion of the bag, and permit the bag to open as more trash is inserted. The construction of the device is adequately sturdy to support most household trash, but clearly the legs may be made of any appropriate size and strength as needed to support heavier material inserted into the bag.

DESCRIPTION OF THE PREFERRED EMBODIMENTS

Referring now to the embodiment of the invention illustrated in the accompanying drawings, the device of the present invention is generally designated 10, and is seen to include a plurality of legs 12 which are generally L-shaped, with the short leg of the "L" being turned inwardly. The lower termini of the legs 12 are secured to a base plate 14 by means of bolts or rivets 16 in such a manner that the attaching points are substantially equally spaced. If desired, a suitable rubber "foot" 18 may be attached around the leg 12 to prevent marring of the floor.

At their upper ends, the legs 12 are attached to upper ring 20. To facilitate this attachment, the ends of the legs 12 may be flattened as at 22, so that bolts or rivets 24 may be easily used for the attachment. The upper ring is a strip of thin material which is generally circular and has a height of approximately 2–4 inches. The diameter is of any convenient dimension and of course is chosen such that the bag 26 to be used may be inserted therein, and turned down around the outside of the ring 20, as seen in FIG. 4.

The lid assembly is seen to include a first U-shaped hinge member 28 to which is attached an elastic band 30. The band 30 is of a size such as to be capable when stretched of encircling the upper ring 20 and the bag 26, in this manner holding the bag 26 securely in place on the upper ring. The elastic band 30 may be secured simply by knots 40 in the ends thereof, or in any other suitable fashion.

The lid assembly also includes a second hinge member 32 to which is attached a lid member 34. The hinge member 32 may be attached to the lid 34 by screws or rivets (not shown) or the two elements may be formed as a one-piece molded structure. The two hinge elements 28 and 32 are of cooperating shapes and are provided with apertures for receiving a hinge pin 36. In the embodiment shown, the hinge pin 36 is a generally U-shaped member which can also serve as a handle for the lid assembly.

The lid 34 is of a such a size that it is slightly larger than the upper ring 20, and preferably includes a downwardly turned edge portion 38 so that in the closed position as seen in FIG. 2, the lid completely covers the open top of the bag 26 and encircles the bag and the upper ring 20 in order to provide a seal with the top of the bag.

When the bag becomes full, the lid assembly is removed and the bag and contents are removed from beneath the ring and then discarded in the usual manner. Thus, it is seen that the open base portion of the bag enables the easy removal of the bag as well as facilitating the insertion and expansion of a new bag into the device. Clearly, however, if the top is of a sufficiently large size, the filled bag could be removed through the upper ring.

Moreover, the lid assembly itself could be used with a conventional trash receptacle of a rigid nature, such as a trash can. In this case, the lid would be sized in such a manner as to similarly cover the open top of the trash can, and would be held in place in the same manner by the elastic band, and an improved bag supporting structure would again result.

Further, the structure of the lid assembly is such as to provide a secure cover for the bag, without interfering with the attachment of the lid or hinge, as the hinge is on the outside of the bag.

While this invention has been described as having certain preferred features and embodiments, it will be understood that it is capable of still further variation and modification without departing from the spirit of the invention, and this application is intended to cover all variations, modifications and adaptations as fall within the spirit of the invention and the scope of the appended claims.

We claim:

1. A support for a flexible trash receptacle comprising an upper ring, a plurality of support legs secured in spaced relation at their lower ends and secured at their upper ends to said upper ring for supporting said upper ring, a removable lid assembly comprising a lid member and first and second hinge members, said lid assembly being secured to said upper ring by a resilient band encircling said upper ring and connected to said first hinge member, and said lid member being secured to said second hinge member in position such as to cover said upper ring in the closed position, said first and second hinge members being hingedly connected by hinge pin means.

2. A support for a flexible trash receptacle as in claim 1 and wherein said support legs are connected to a base plate at their lower ends.

3. A support for a flexible trash receptacle as in claim 1 and wherein said lid member includes a downwardly turned edge portion for overlapping said upper ring in the closed position.

4. A support for a flexible trash receptacle comprising an upper ring, a plurality of support legs secured in spaced relation at their lower ends and secured at their upper ends to said upper ring for supporting said upper ring, a removable lid assembly comprising a lid member and first and second hinge members, a flexible trash receptacle having an open top positioned within said support and having its open top extending upwardly through said upper ring and turned downwardly around said upper ring, said lid assembly and said flexible trash receptacle being secured to said upper ring by a resilient band encircling said upper ring and connected to said first hinge member, and said lid member being secured to said second hinge member in position such as to cover said upper ring and the open top of said flexible trash receptacle when in the closed position.

5. A support for a flexible trash receptacle as in claim 4 and wherein said support legs are connected to a base plate at their lower ends.

6. A support for a flexible trash receptacle as in claim 4 and wherein said lid member includes a downwardly turned edge portion for overlapping said upper ring and the open top of said flexible trash receptacle in the closed position.

* * * * *